United States Patent [19]

Rohde et al.

[11] Patent Number: 4,711,109

[45] Date of Patent: Dec. 8, 1987

[54] CONTROLLING THICKNESS AND PLANARITY OF HOT ROLLED STRIPS

[75] Inventors: Wolfgang Rohde, Dormagen; Jürgen Klöckner, Netphen, both of Fed. Rep. of Germany

[73] Assignee: SMS Schloemann-Siemag, A.G., Dusseldorf, Fed. Rep. of Germany

[21] Appl. No.: 845,478

[22] Filed: Mar. 27, 1986

Related U.S. Application Data

[63] Continuation of Ser. No. 589,409, Mar. 14, 1984, abandoned.

[30] Foreign Application Priority Data

Mar. 14, 1983 [DE] Fed. Rep. of Germany ..... 3309040
Jan. 20, 1984 [DE] Fed. Rep. of Germany ..... 3401894

[51] Int. Cl.[4] ..... B21B 37/00

[52] U.S. Cl. ..... 72/8; 72/11; 72/16; 72/17; 72/234; 72/366

[58] Field of Search ..... 72/8, 9, 10, 11, 12, 72/16, 17, 234, 365, 366, 199

[56] References Cited

U.S. PATENT DOCUMENTS 3,599,459 8/1971 Yeomans et al. ..... 72/8
3,782,152 1/1974 Sabatini ..... 72/17 X
3,839,888 10/1974 Greenberger ..... 72/17
3,841,124 10/1974 Shida et al. ..... 72/17
3,855,830 12/1974 Kitanosono et al. ..... 72/16 X
3,882,709 5/1975 Kawamoto et al. ..... 72/234
3,934,438 1/1976 Arimura et al. ..... 72/9
4,261,190 4/1981 Fapiano ..... 72/17 X

FOREIGN PATENT DOCUMENTS 2228548 1/1974 France .
57-206512 12/1982 Japan .

*Primary Examiner*—Robert L. Spruill
*Assistant Examiner*—Steve Katz
*Attorney, Agent, or Firm*—Russell & Tucker

[57] ABSTRACT

A metallic strip is hot-rolled in a succession of roll stands arranged in a row by passing the strip longitudinally in a travel direction through the stands. The strip is then compressed in the upstream stands to substantially reduce its thickness measured perpendicular to the travel direction and parallel to the strip while substantially increasing its width measured perpendicular to the travel direction and transverse to the strip. Then in the downstream stands it is compressed and tensioned without substantially increasing its width to level it and stretch it longitudinally in the travel direction. With standard steel strip this critical thickness is about 12 mm. The local band thickness is measured downstream of the upstream roll stands and the furthest downstream stand of the upstream stands is operated to eliminate any nonuniformities in thickness thus detected. The nonuniformities are detected by comparing the local band thicknesses detected with standard set-point thicknesses.

7 Claims, 7 Drawing Figures

OVERALL THICKNESS
PLANARITY
LOCAL THICKNESS
MASTER CONTROLLER
UNIT CONTROL
CONTROLLER
THICKNESS CONTROL
F1
F2
F3
F4
F5
F6
F7
21
22
23
24
25
26
27
31
32
33
34
35
36
37
41
42
43
44
45
46
47
51
52
53
54
55
56
57
58
59
60
61
62
63
64
30
38
40
48
50
70

CONTROLLING THICKNESS AND PLANARITY OF HOT ROLLED STRIPS

This application is a continuation of application Ser. No. 589,409, filed Mar. 14, 1984 now abandoned.

FIELD OF THE INVENTION

The present invention relates to the hot rolling of metallic, normally steel, strip. More particularly this invention concerns the regulation and correction of strip shape in such a hot-rolling system.

BACKGROUND OF THE INVENTION

When a strip is being hot rolled for instance from a starting thickness of 30 mm to 40 mm to a finished thickness of 2 mm to 10 mm prior to cold finish-rolling, it is necessary to make constant corrections in the strip shape. The rotation speed of the rolls, the roll spacing, the tension in the strip, and so on can be adjusted according to well established procedures (see for instance copending application Ser. Nos. 352,520 filed Feb. 26, 1983, 379,890 filed May 19, 1985, 558,165 filed Dec. 5, 1983, and 587,231 filed Mar. 07, 1984) to control three major aspects of the workpiece: its thickness, its planarity, and its width. The thickness is fairly critical as is the planarity, and the width is normally easy to control.

Thickness corrections in long workpieces such as strips or long plates are normally also reflected in changes in workpiece width. The extent of deformation in the width direction, that is parallel to the plane of the workpiece and perpendicular to its longitudinal travel direction through a stand, is a function of the geometry of the roll stand, the size of the rolls, the workpiece thickness, temperature, and composition, as well as the friction between the workpiece and the rolls and the tension in the workpiece.

Corrections of planarity are typically associated with longitudinal stretching or elongation of the strip in the travel direction. Such a correction does not substantially affect workpiece width but has some effect on workpiece thickness, uniformly reducing it.

As mentioned the steps taken to control thickness also affect planarity. In the cold-rolling operation following the hot-rolling one it is necessary to start with a high-tolerance workpiece both with regard to thickness uniformity and to planarity to produce a high-tolerance end product. Any attempt to correct thickness irregularities during cold rolling is reflected in wide deviations from planarity. Even a correction of a thickness nonuniformity amounting to one hundredth of the workpiece thickness can result in a bulge in the workpiece some 22 mm high and 1 m long, albeit the workpiece is of uniform thickness. Thus extreme care must be taken to supply a relatively planar workpiece of substantially uniform thickness to the cold-rolling operation.

When the thickness is adjusted in the first stand of a hot-rolling line normally comprising five or more stands, the correction is normally not perceptible at the downstream output end of the line, that is the downstream stands eliminate the correction. The planarity does not change however. Trying to make any substantial changes in the nip shape of the output stand leads to simultaneous changes in thickness and planarity. Thus it has been assumed that the thickness can only be permanently changed in the output stand, and that this must be done gradually with the runs of the workpiece through the equipment. Hence producing a hot-rolled workpiece satisfying high tolerances regarding thickness uniformity and planarity or levelness has a been a difficult and expensive process, albeit such a hot-rolled workpiece is the essential starting material needed for the production of high-tolerance cold-rolled strip.

OBJECT OF THE INVENTION

It is therefore an object of the present invention to provide an improved method of and system for hot-rolling.

Another object is the provision of such a method of and system for hot-rolling which overcomes the above-given disadvantages, that is which produces a strip of nearly perfectly uniform thickness and near perfect planarity, for subsequent cold-rolling into a high-tolerance finished product.

SUMMARY OF THE INVENTION

A metallic strip is hot-rolled in a succession of roll stands arranged in a row by passing the strip longitudinally in a travel direction through the stands. The strip is then compressed in the upstream stands to substantially reduce its thickness measured perpendicular to the travel direction and parallel to the strip while substantially increasing its width measured perpendicular to the travel direction and transverse to the strip. Then in the downstream stands it is compressed and tensioned without substantially increasing its width to level it and stretch it longitudinally in the travel direction.

The invention is based on the recognition that the thickness of a strip can be changed without affecting workpiece planarity as long as the workpiece thickness exceeds a critical thickness, defined here as being that thickness at which reductions in thickness do not bring about a substantial increase in width. Below this critical thickness any squeezing to reduce thickness will meet substantial resistance to transverse flow that would result in a change in width, so that nonplanarities in the workpiece are created instead. With standard steel strip this critical thickness is about 12 mm and can readily be determined empirically for other materials.

According to another feature of this invention the local band thickness is measured downstream of the upstream roll stands and the furthest downstream stand of the upstream stands is operated to eliminate any nonuniformities in thickness thus detected. This local thickness measurement actually constitutes a series of measurements taken transversely across the entire workpiece width. The nonuniformities are detected by comparing the local band thicknesses detected with standard set-point thicknesses.

In addition according to the method of this invention longitudinally short changes in strip thickness are sensed at the stands as increases in pressure and are compared with predetermined set points for correction of strip thickness.

The apparatus or system according to this invention therefore has a succession of roll stands arranged in a row. The strip passes longitudinally in a travel direction through the stands. Means is provided in the upstream stands relative to the travel direction for compressing the strip and thereby substantially reducing its thickness measured perpendicular to the travel direction and parallel to the strip while substantially increasing its width measured perpendicular to the travel direction and transverse to the strip. Means is provided in the downstream stands relative to the travel direction for compressing and tensioning the strip without substantially increasing its width to level and longitudinally stretch the strip in the travel direction.

Rather than providing a separate thickness and/or planarity sensor for each roll stand, according to this invention only the furthest downstream roll stand of the upstream roll stands can be operated to reduce the thickness of the strip or to level it, whereby when the strip is particularly thin this stand can serve to level it rather than reduce its thickness.

According to a further feature of the invention the furthest downstream of the upstream roll stands is provided downstream of itself with sensor means for detecting local strip thickness and means for detecting strip planarity. The upstream roll stands have a nip height of more than about 12 mm.

The system of this invention can have sensors downstream of the upstream roll stands for measuring local strip thickness, sensors downstream of the upstream roll stands for measuring strip planarity and for generating an output corresponding thereto, and comparator means connected to the actuation means of the roll stands and to both sensors for comparing the outputs of the sensors with set points and for actuating the roll stands to eliminate nonuniformities in thickness detected by the thickness sensors and for eliminating nonplanarities detected by the planarity sensors. These sensors can all be downstream of all of the roll stands, or a thickness sensor can be immediately downstream of the upstream roll stands.

In this arrangement planarity correction takes place only in the furthest downstream stand of the hot-rolling line. To correct thickness measurements are taken at the output end of the rolling line. A predetermined characteristic curve that is determined by workpiece size and material and the particular rolling equipment is then used to set the necessary correction in the gap of the last stand. Subsequently the further upstream roll stands are adjusted. The various actuators of the upstream roll stands are operated in accordance with the necessary changes in shape of the roll nip. The adjustment is synchronized with the displacement of the workpiece through the roll stands. If the thus corrected workpiece still has some problems, the automatic resetting operation is repeated. The critical planarity adjustment is done immediately upstream of the sensor, so that this adjustment is carried out very responsively and rapidly.

The thickness adjustment is dependent on the displacement rate of the strip through the rolling line, with the adjustment lagging at least by the time it takes an error created at the first roll stand to find its way to the sensor at the downstream end of the line. Such slow reaction time is acceptable for slowly developing flaws created by thermal shape change or simple wear of the rolls. Suddenly appearing thickness irregularities, so-called skidmarks, cannot be regulated out and have a substantial effect on planarity and thickness uniformity. In addition a measurement taken at such a longitudinally short flaw can trigger a roll correction that in reality damages the workpiece.

Thus according to this invention the adjustment at each roll stand is carried out with respect to the pressure being exerted by the workpiece against the rolls, which pressure is easily determined from the pressure in the backup-roll actuators. The set-point change necessary to compensate for such change can be done automatically. Thus the changes in the rolling force of each stand is determined and changes in this force are compensated for by use of predetermined curves.

It is normal for a rolled strip to be between 0.5% and 1.5% thicker in its center than at its edges, although typically efforts are made to reduce this oversize in the center to 1% of the nominal thickness. The adjustment range for the setting of the roll nip shape should therefore in ideal circumstances be 0.75% and must have sufficient reserves for compensating for rolling-force changes and other disturbances.

Thus with a finished product thickness of 3 mm the adjustment range should be 0.0225 mm for the last frame. Modern bending systems for the working rolls have with average or full-width operation an adjustment range of more than 0.1 mm +/−0.05 mm, so that relatively large adjustment reserves are present. For the upstream roll stands, however, the adjustment ranges must be correspondingly greater. Thus in addition to the standard adjustment range provided by the usual bending devices, it is necessary to provide further adjustment capacity. This can be done by thermally shaping the rolls, heating them locally to increase diameter or cooling them to decrease diameter. Axial shifting of the rolls is similarly possible. Since such means normally are relatively slow, however, it is standard to use them so that the faster-acting bending devices are working in the centers of their ranges.

In some cases, for example in the hot-rolling of aluminum, it can be sufficient to use only the bending system for roll-nip adjustment. Such arrangements are heavily lubricated and can therefore limit the thickness and planarity corrections to the last two or three roll stands. In the rolling of steel without lubrication at least two to five of the downstream roll stands are necessary, the lower number being used for thicknesses in excess of 5 mm and the higher number for smaller end-product thicknesses.

As already mentioned, in the hot-rolling of steel it is only above a thickness of 12 mm that a meaningful thickness correction is possible due to the ability of the steel to flow transversely. Thus adjustment means are necessary whose nip heights are under the critical thickness. The necessary adjustment range thus will be $$(+/-0.75)/100 \cdot 12 \text{ mm} = +/-0.09 \text{ mm}.$$

This is of course more than many modern bending devices can manage, so a thermal shaping, which can add or subtract another −0.04 mm can be used. It is in fact normal according to this invention to combine many types of roll-nip adjustment, including axial shifting of working and backup rolls, bending the rolls, and heating and/or cooling the rolls.

DESCRIPTION OF THE DRAWING

The above and other features and advantages will become more readily apparent from the following, reference being made to the accompanying drawing in which.

SPECIFIC DESCRIPTION

Figure 1:
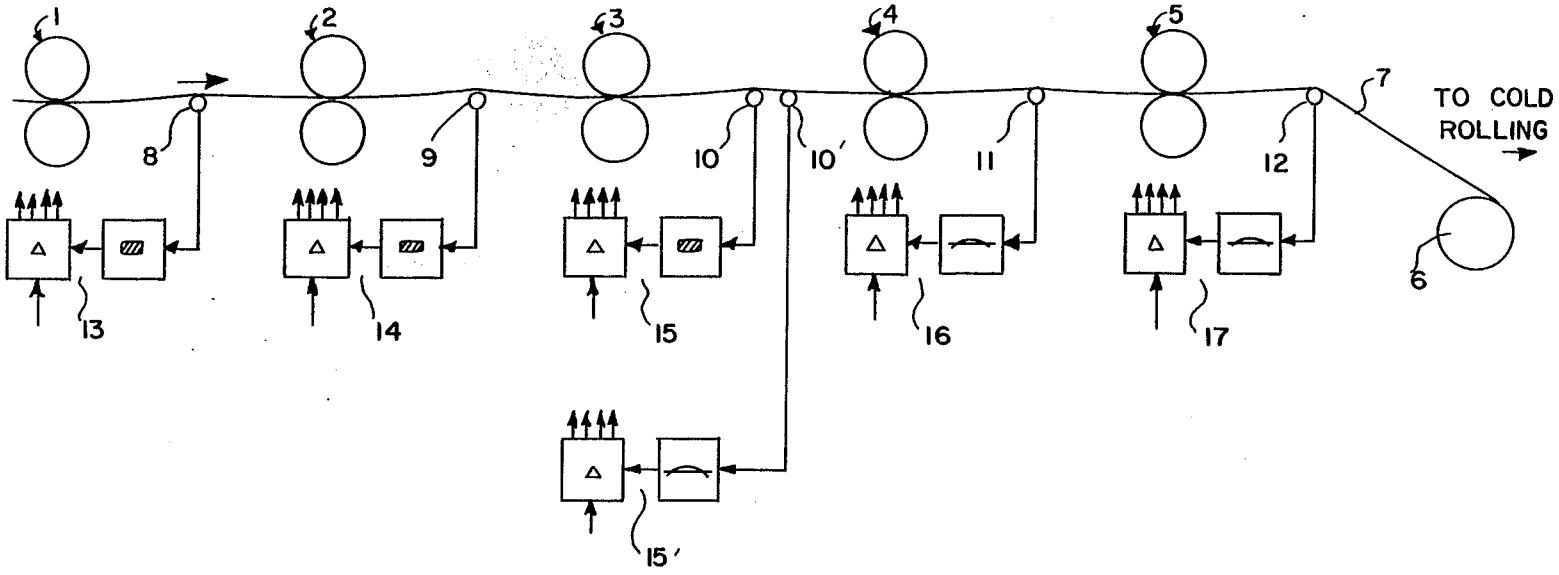
FIG. 1 is a largely schematic side view of a system for carrying out the method of this invention.

As seen in FIG. 1 a row of rolling stands 1, 2, 3, 4, and 5 is traversed by a strip-steel workpiece 7 that is wound up at 6 or passed directly to a cold-rolling operation. Downstream of each of the stands 1, 2, and 3 in the travel direction D is a respective sensor 8, 9, and 10 capable of measuring the thickness of the strip 7. Such a sensor can be constituted of a roll which is formed of a plurality of relatively movable roll sections and over which the workpiece 7 is deflected somewhat. Downstream of each of the downstream stands 4 and 5 is a respective planarity sensor 11 and 12 typically of the optical type, and another such sensor 10' is provided upstream of the stand 4 and immediately downstream of the sensor 10.

The sensors 8, 9, and 10 are connected to respective control units 13, 14, and 15 connected to the respective roll stands 1, 2, and 3 and capable of changing the shape of the nips of these roll stands to compensate for thickness variations sensed downstream of themselves in standard servocontrol manner. This change in nip-height alteration can be done by axially shifting inner backup rolls in a six-high stand, by bending some of the rolls, by locally heating or cooling the backup or working rolls, or in accordance with the so-called CVC system of German patent No. 3,038,865. The planarity sensors 10', 11, and 12 are connected to respective control units 15', 16, and 17 connected in turn to the roll stands 3, 4, and 5. These units 15', 16, and 17 are capable of operating the stands 3, 4, and 5 in such a manner as to level or planify the strip, mainly by varying the drive speeds of these stands 3, 4, and 5. The control units 15 and 15' operate alternately.

The units 13 through 17 all compare the outputs of the respective sensors 8 through 12 with set-point signals supplied from an external source. When a difference is detected, a correction is made in the roll nip to eliminate this difference.

Under any circumstance the system is operated so that at least by the time the strip 7 has left the stand 3 its thickness is very uniform. Similarly at least by this time it is generally at the critical thickness, which is about 12 mm thick as described above for standard steel strip, so that further thickness reduction only results in a negligible width increase.

Figure 2:
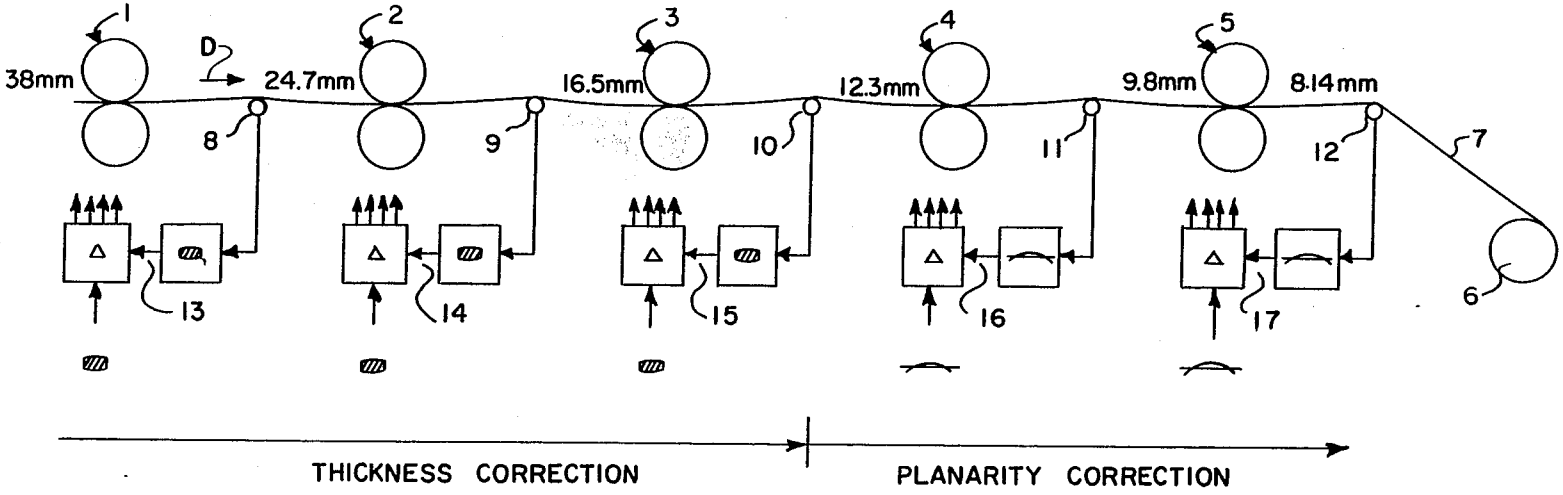
FIG. 2 is a view showing the system of FIG. 1 operating in a thick-workpiece mode.

FIG. 2 shows how the system operates with a relatively thick strip 7 having a starting thickness of 38 mm. Passage in the direction D through the stands 1, 2, and 3 successively reduces the workpiece thickness to 24.7 mm, 16.5 mm, and finally 12.3 mm, the above-given critical thickness. Meanwhile the stands 1, 2, and 3 have been adjusting and compensating for variations in thickness as determined by the respective sensors 8, 9, and 10, so that by the time the workpiece has left the third stand 3, it is of substantially uniform thickness.

Passage through the two downstream roll stands 4 and 5 reduces the thickness from 12.3 mm to 9.8 mm and then to 8.14 mm. This reduction in thickness is achieved in large part by longitudinally elongating the band to eliminate any nonplanarity in it. Nonplanarities in the workpiece 7 are detected by the sensors 11 and 12 and used by the control units 16 and 17 to make the necessary corrections to ensure near-perfect planarity.

Figure 3:
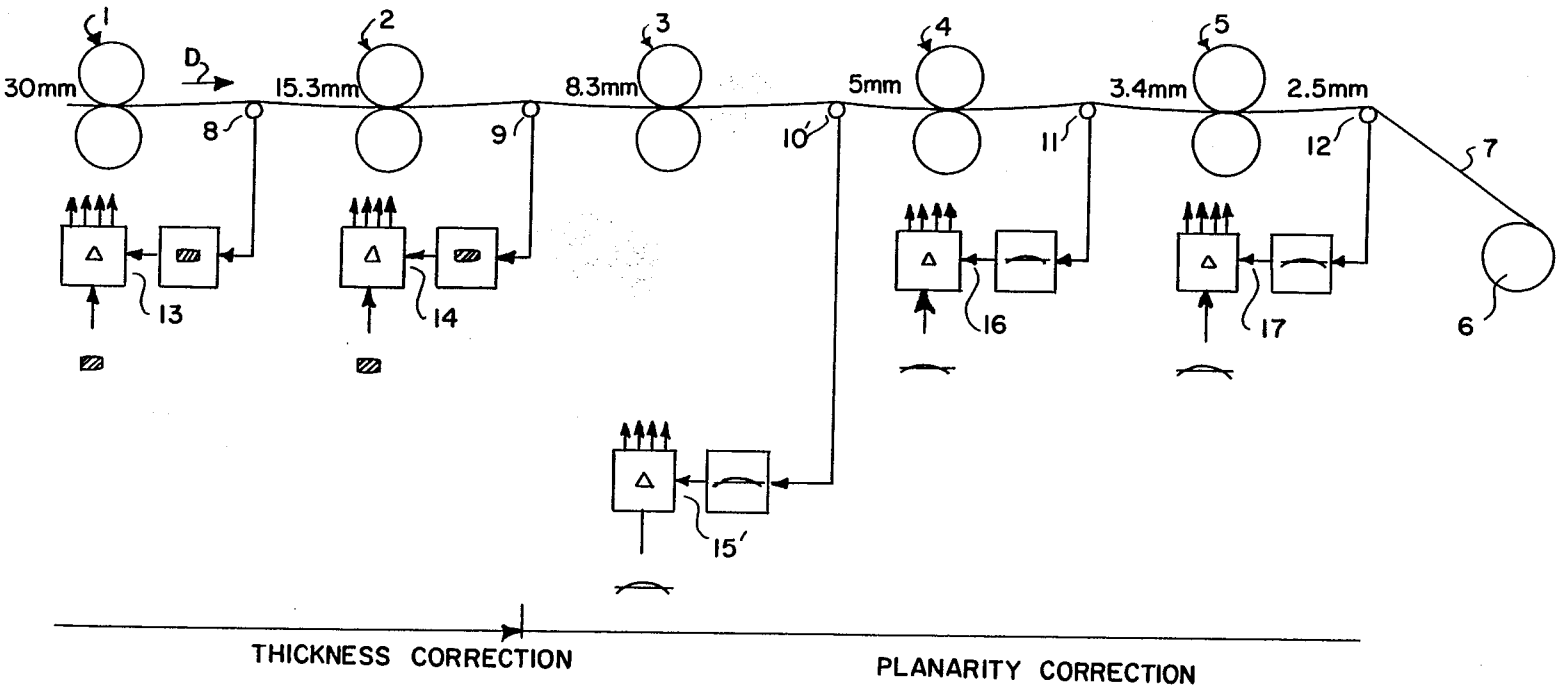
FIG. 3 is a view showing the system of FIG. 1 operating in a thin-workpiece mode.

With a thin workpiece as shown in FIG. 3 the starting thickness of 30 mm is reduced to 15.3 mm in the first upstream roll stand 1, then to 8.3 mm in the second upstream roll stand 2, both of which are operating in self-adjusting manner to eliminate thickness variations detected by the respective sensors 8 and 9. Thus before entering the third roll stand 3 the workpiece 7 has already been reduced to a thickness less than the critical thickness of about 12 mm.

In accordance with the instant invention, therefore, the third stand 3 is operated for planarity correction by the sensor 10' and unit 15'. The thickness correction controlled by the sensor 10 and unit 15 is switched off so that rather than control being focussed mainly on altering the nip shape, it is focussed on controlling or monitoring the drive speed to produce a stretch-type planarity correction. The workpiece thickness is reduced somewhat to 5 mm by the stand 3. The downstream two planarity-correcting stands 4 and 5 operate the same as for a thick workpiece, and here successively reduce the workpiece thickness to 3.4 mm and 2.5 mm.

In these arrangements it would be possible to provide a single thickness-control sensor that operates all of the thickness-correcting stands, or to connect their control units together for joint operation. The sensors for the stands can be placed further downstream if desired also. A single stand at the downstream end of the two or three downstream stands that are substantially reducing workpiece thickness can do all of the actual correction of thickness uniformity, letting the other stand or stands serve principally to reduce overall thickness. The rolls of the stands can be of the diameter used in standard hot- and cold-rolling tandem rolling plants.

Either mode of operation will produce a finished product of extremely uniform thickness and near perfect planarity. Cold-rolling such a workpiece can produce a finished product of very high tolerances, the workpiece of FIG. 3, for example, being ideal for reduction to a thickness of about 0.3 mm.

Figure 4:
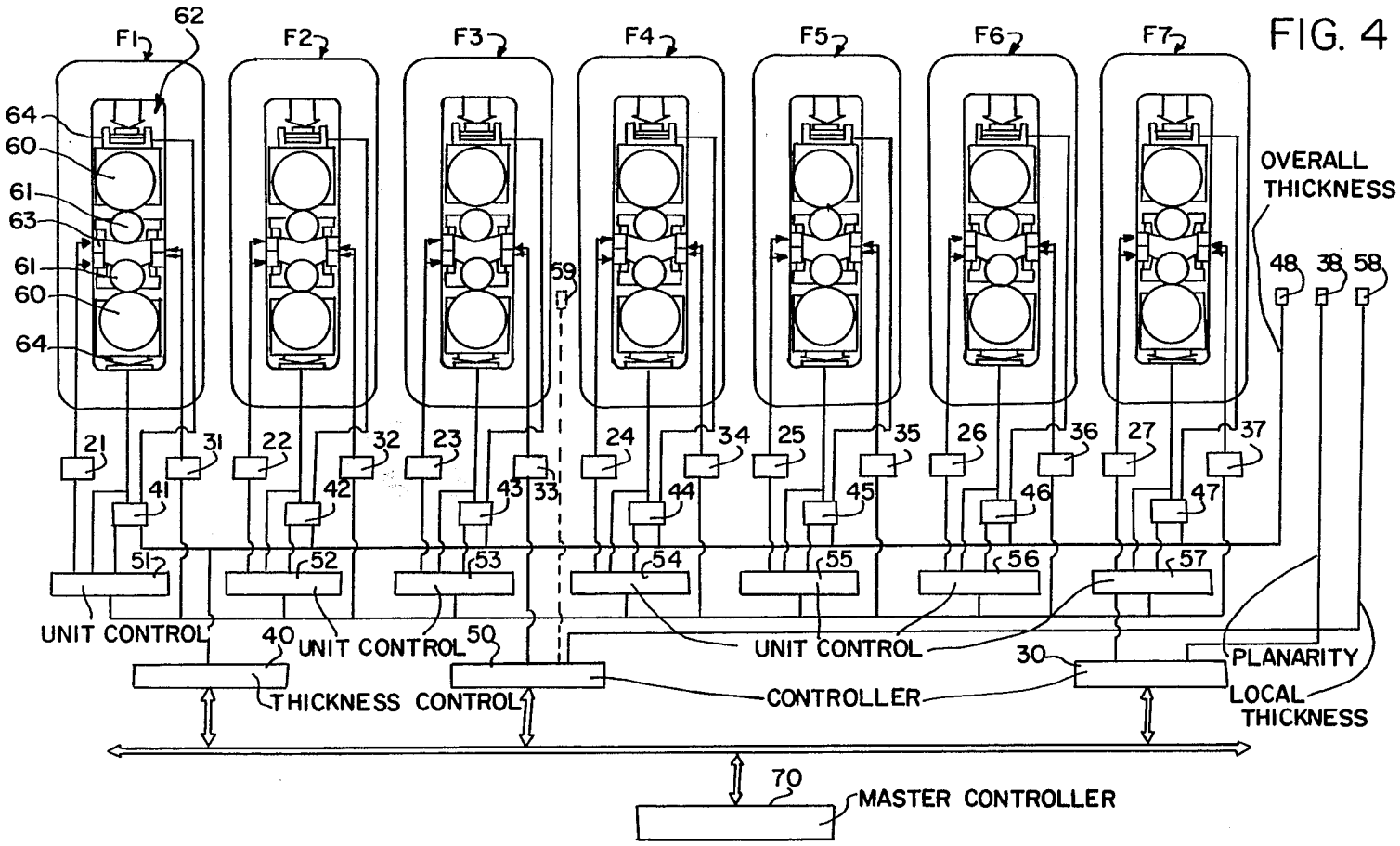
FIG. 4 is a view like FIG. 1 of another system according to this invention.

FIG. 4 is a side view of a rolling string having seven substantially identical roll stands F1–F7 each having a frame 62, large-diameter backup rolls 60, and small-diameter working rolls 61. The shape of the nip defined by the rolls 60 is changed by the actuators 63 and the overall height of this nip is determined by actuators 64 as described in the above-cited patent applications.

Respective control units 21–27 serve for compensating and bending the working rolls 61 of the stands F1–F7, control units 31–37 regulate the axial displacement of the rolls 61, and control units 41–47 serve for setting the overall nip height.

A common thickness controller 40 is connected to all of the units 41–47 to monitor and control overall workpiece thickness reduction in the assembly. Individual computer-type unit controllers 51–57 are connected to the control units 21–27 and 41–47 and directly to the actuators 64. A central controller 50 is in turn connected to all the unit controllers 51–57 and also to the axial-shifting units 31–37.

A sensor 48 downstream of the last stand F7 determines the average or overall thickness of the workpiece and feeds this signal to the control units 41–47 and to the thickness controller 40. Another sensor 58 determines local thickness and feeds this information to the controller 50 which bends and/or shifts rolls to compensate out local variations in thickness. A planarity sensor 38 is connected to a controller 30 connected in turn only to the unit controller 57 for correcting the planarity of the workpiece in the last stand F7. A master controller 70 oversees the operation of all the controllers 30, 40, and 50.

Another such planarity sensor 59 can be provided downstream of the stand F3 where the workpiece is reduced to or past the above-discussed critical thickness. It is connected to the controller 50 which can effect the necessary planarity corrections in the unit controllers 54, 55, 56, and 57.

Comparison of the readings of the two sensors 58 and 59 allows the operation of the equipment itself to be monitored. Overall or local wear in the rolls can thus be easily detected.

Figure 5:
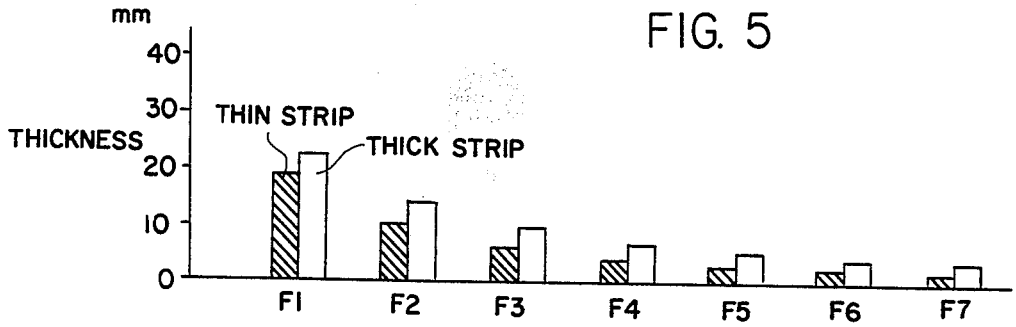

FIG. 5 shows how the seven-stand system of FIG. 4 reduces the thickness of a thin strip (hatched bars) and a thick strip (blank bars) to the critical thickness after the second and third stages F2 and F3, respectively. At the end the thin and thick strips have respective overall thicknesses of 2 mm and 4 mm.

Figure 6:
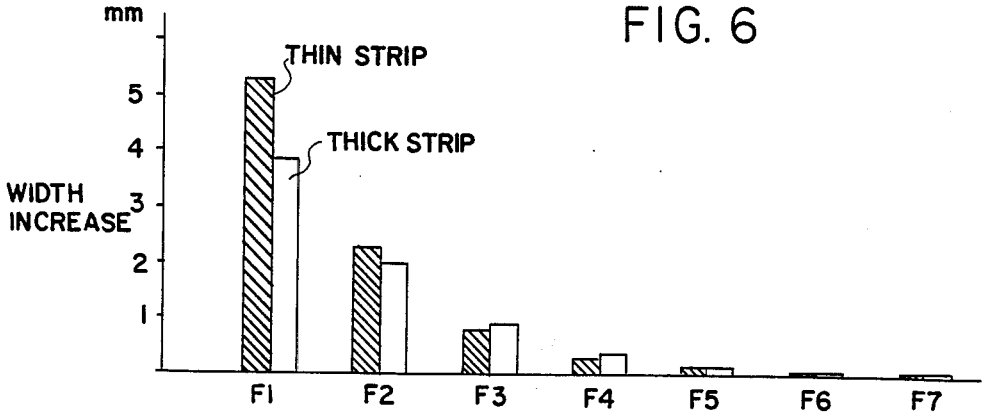

The thickness reduction shown in FIG. 5 is accompanied by the increase in width illustrated in FIG. 6. Thus it is obvious that the falloff of width increase follows a substantially flatter curve than the decrease in thickness. The dramatic thickness increases in the first two stages F1 and F2 are substantially reduced by the stages F3 and F4 so that in stages F5–F7 there is only a negligible increase of width of about 0.1 mm. The curve of these thickness increases is therefore generally asymptotic.

Figure 7:
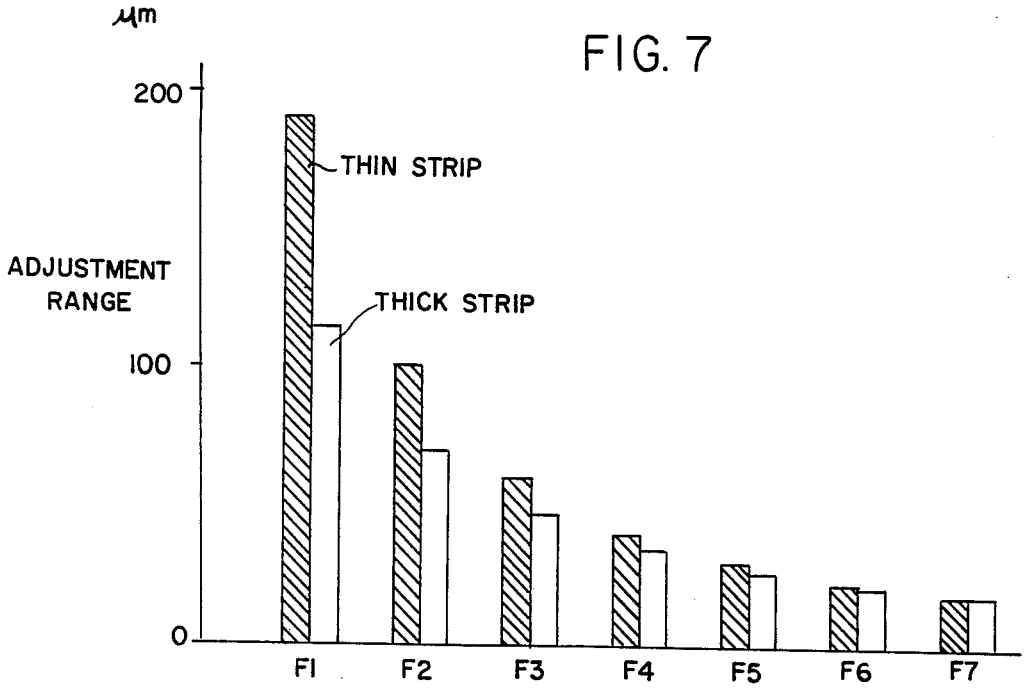
FIGS. 5, 6, and 7 are bar graphs illustrating the operation of the system of FIG. 4 with the bars for thin-mode operation shown hatched.

FIG. 7 shows the positioning commands for the various stands calculated according to the above-given formulas. Since the critical thickness is undershot by the stand F3, the adjustment range of the bending in the stands F5–F7 is sufficient, and the adjustment range of the working-roll bending units in unfavorable circumstances F4 is insufficient. Thus the bending system is augmented by an axial shifter of the CVC type referred to above. Such returning of the adjustment to the middle of its range is dependent on the equipment and various circumstances.

In addition adjustment of the roll nip can use up what transverse material flow can still take place in even thin workpieces.

We claim:

1. A method for hot rolling strip metal comprising the steps of:

(a) determining the critical thickness of the metal in process at which reductions in thickness do not bring about a substantial increase in width;

(b) hot rolling strip stock of said metal, said stock having a thickness substantially thicker than said crictical thickness, sequentially through a first and second rolling stage in each of which stage said stock is passed through a roll pass comprising at least one deforming nip of at least one roll stand;

(c) reducing the thickness of said stock in said first stage to substantially said critical thickness;

(d) controlling the thickness reduction of said stock in said first stage by sensing the thickness of said stock downstream of said first stage and adjusting the height of said nip at at least the final roll stand in said first stage in response to the thickness measured;

(e) sensing the planarity of said stock at said second stage at at least one point downstream of the roll pass thereof; and (f) reducing the thickness of said stock in said second stage to a thickness substantially below the thickness of said critical thickness while controlling the roll pass of that stage only in response to said planarity sensor.

2. The method according to claim 1, wherein the height of the nip at at least the final roll stand in said first stage is adjusted in response to a comparison of the thickness measured downstream of said first stage to a predetermined standard.

3. The method according to claim 1, wherein the planarity of said stock is sensed with reference to a predetermined planarity standard.

4. The method according to claim 1, wherein the thickness reduction said stock in said first stage is controlled in response to sensing the thickness of said stock downstream of the second stage.

5. A system for hot rolling strip metal in which the critical thickness of the metal in process has been determined, comprising:

(a) means comprising a first stage roll stand for compressing and thereby reducing the thickness of the metal strip in process from a thickness greater than said critical thickness of sid metal down to substantially the same as said critical thickness thereof;

(b) first sensing means located downstream of said first stage for sensing the thickness of said strip as it leaves the first stage:

(c) first controlling means operatively connected between said first sensing menas and said first stage rolling stand means for adjusting said first stage of roll stand means in response to the thickness of said strip sensed by said first sensing means:

(d) means comprising a second stage roll stand for further reducing the thickness of said strip:

(e) second sensing means located downstream of the second stage or roll stand means for detecting nonplanarities in the strip after it emerges from the second stage or roll stand means: and (f) second controlling means operatively connected between said second sensing means and the second roll stand means for controlling the second stage of roll stand means in response only to detected nonplanarities sensed by the second sensing means.

6. The system according to claim 5, wherein the first sensing means is located downstream of the second stage roll stand means.

7. The system according to claim 5, wherein the first sensing means is located immediately downstream of the first stage of roll stand means.

* * * * *